US006286675B1

(12) United States Patent
Schmidt

(10) Patent No.: US 6,286,675 B1
(45) Date of Patent: Sep. 11, 2001

(54) BLADE DISPOSAL APPARATUS AND HOLDER UNIT

(75) Inventor: G. Gerry Schmidt, Newport Beach, CA (US)

(73) Assignee: Pacific Handy Cutter, Inc., Costa Mesa, CA (US)

( * ) Notice: Subject to any disclaimer, the term of this patent is extended or adjusted under 35 U.S.C. 154(b) by 0 days.

(21) Appl. No.: 09/493,316

(22) Filed: Jan. 28, 2000

(51) Int. Cl.[7] ..... B65F 1/00

(52) U.S. Cl. ..... 206/359; 206/354; 206/459.5; 220/475

(58) Field of Search ..... 206/352, 359, 206/366, 370, 354, 459.5; 220/475, 908; 248/218.4, 219.4

(56) References Cited

U.S. PATENT DOCUMENTS

| | | | | |
|---|---|---|---|---|
| D. 228,745 | | 10/1973 | Glaberson et al. | D9/186 |
| D. 238,252 | | 12/1975 | Meshulaua | D9/193 |
| D. 307,841 | | 5/1990 | Hanifl et al. | D6/515 |
| D. 334,449 | | 3/1993 | Gaba et al. | D34/6 |
| 1,476,401 | | 12/1923 | Hechmer . | |
| 1,634,777 | * | 7/1927 | Girdler | 206/359 |
| 1,770,289 | | 7/1930 | Sherman et al. . | |
| 1,910,374 | | 5/1933 | Williams . | |
| 2,006,696 | * | 7/1935 | Koeble | 206/359 |
| 2,065,607 | | 12/1936 | Morgan . | |
| 2,071,978 | * | 2/1937 | Hines | 206/359 |
| 2,182,615 | * | 12/1939 | Johnson | 206/359 |
| 2,231,726 | * | 2/1941 | Locke, Jr. | 206/359 |
| 2,441,777 | | 5/1948 | Testi | 206/16 |
| 2,453,238 | | 11/1948 | Locke, Jr. | 206/16 |
| 3,255,913 | | 6/1966 | Helm | 220/18 |
| 4,711,367 | * | 12/1987 | Albertson | 220/475 |
| 4,715,498 | | 12/1987 | Hanifl | 206/366 |
| 4,759,441 | | 7/1988 | Leurck | 206/373 |
| 4,809,850 | | 3/1989 | Laible et al. | 206/366 |
| 5,058,764 | | 10/1991 | Gaba | 220/481 |
| 5,240,107 | * | 8/1993 | Casale | 206/354 |
| 5,887,774 | * | 3/1999 | Bethune | 220/475 |
| 5,894,925 | | 4/1999 | Sukiennik et al. | 206/356 |
| 5,901,874 | * | 5/1999 | Deters | 220/908 |

OTHER PUBLICATIONS

Cut Saver Razor Blade Disposal Unit brochure (photocopy of brochure).

Cut Saver, Cut Saver Razor Blade Disposal Unit brochure, published in 1999.

* cited by examiner

*Primary Examiner*—Jim Foster
(74) *Attorney, Agent, or Firm*—Henricks, Slavin & Holmes LLP

(57) ABSTRACT

A blade disposal apparatus includes a blade disposal unit and a holder unit. The blade disposal unit is formed with a slot sized to receive a razor blade and with a vertical channel and horizontal grooves which allow the blade disposal unit to be readily secured to a variety of different objects using ties. The blade disposal unit is also ergonomically shaped with curved corner portions which also make it safer. The blade disposal unit is formed with visible indicia, such as instructions for using the apparatus and/or safety information, which cannot readily be removed, obliterated or tampered with. For example, the visible indicia are formed from raised and/or sunken portions of the blade disposal unit. The holder unit includes a main compartment sized to receive the blade disposal unit. The holder unit is formed such that the visible indicia are exposed (i.e., visible) when the blade disposal unit is inserted into the holder unit. The holder unit also includes a blade compartment sized to receive a box a razor blades.

7 Claims, 12 Drawing Sheets

134
108
126
150
110
106
180
102
152
184
146
186
130
188
118
144
140
192
194
132
120
182
190
128
USED
BLADES
CAUTION
CONTAINS
SHARP
BLADES 220
202
104
200
204
212
230
234

220
202
222
104
210
206
204
212
230
234
224
226
200

BLADE DISPOSAL APPARATUS AND HOLDER UNIT

CROSS-REFERENCE TO RELATED APPLICATIONS

This application is related to U.S. design patent application Ser. No. 29/117,647 entitled "Blade Disposal Apparatus", U.S. design patent application Ser. No. 29/117,648 entitled "Holder Unit For A Blade Disposal Apparatus" and U.S. design patent application Ser. No. 29/117,646 entitled "Holder Unit For A Blade Disposal Apparatus", all three filed herewith.

BACKGROUND OF THE INVENTION

1. Field of Invention

The present invention relates generally to a blade disposal apparatus and, more specifically, to a disposable blade receptacle and a holder unit configured to hold the blade receptacle and dispense new razor blades.

2. Description of the Related Art

Used razor blades are typically dulled to the point where they are no longer useful as work tools. However, they are still sharp enough to be dangerous and therefore must be disposed of with greater care than ordinary refuse.

Although a variety of receptacles for used razor blades are know to exist, many of them are not particularly well suited for preventing children and pets, as well as adults, from coming into contact with the disposed razor blades. For example, many prior receptacles for used razor blades are containers with lids which can be opened by a curious child or pet. Furthermore, receptacles with lids are potentially dangerous to persons who transport such receptacles because the lid could open allowing the used blades to spill.

Many conventional receptacles for used razor blades are not particularly well suited for being secured to a supporting object in or near the work area. This is problematic because a receptacle for used blades should be stationary, particularly when a worker is attempting to insert a used blade into the receptacle. Furthermore, if the receptacle is not properly secured, it could fall on or slide into a person. Injury is particularly likely if the receptacle has sharp edges or corners and/or the receptacle is heavy because it is holding a large number of discarded razor blades. Thus, a need exists for a blade storage apparatus which is free of sharp edges or corners (which have a significant potential for causing injuries) as well as configured for attachment to a variety of different objects, e.g., a flat surface or a pole.

Another problem with prior receptacles for used razor blades is that they are often not easily identified as such. In other words, prior receptacles often appear to be nothing more than an innocuous container, rather the a container full of dangerous used razor blades. Thus, a need exists for a used blade receptacle which is marked with visible indicia identifying the receptacle for what it is. Furthermore, there is a need for a blade storage apparatus which includes instructions for using the apparatus and/or safety information which cannot readily be removed, obliterated or tampered with.

SUMMARY OF THE INVENTION

According to an exemplary preferred embodiment of the present invention, a blade disposal apparatus includes a blade disposal unit (or housing) which is formed with a slot sized to receive a razor blade and with a vertical channel and horizontal grooves which allow the blade disposal unit to be readily secured to a variety of different objects using ties. The blade disposal unit is also formed with curved corner portions which make it safer. Additionally, the ergonomic shape of the blade disposal unit makes it easier to grip the blade disposal unit.

In a preferred embodiment, the blade disposal unit is formed with visible indicia, such as instructions for using the apparatus and/or safety information, which cannot readily be removed, obliterated or tampered with. For example, the visible indicia are formed from raised and/or sunken portions of the blade disposal unit.

In a preferred embodiment, the blade disposal apparatus also includes a holder unit with a main compartment sized to receive the blade disposal unit. The holder unit is formed such that the visible indicia are exposed (i.e., visible) when the blade disposal unit is inserted into the holder unit.

In a preferred embodiment, the holder unit also includes a blade compartment sized to receive a box a razor blades. The holder unit includes a bottom surface which is tilted in a manner designed to lessen the chance that the box of razor blades will fall out of the blade compartment when the holder unit is in an upright position.

In another exemplary preferred embodiment, a blade disposal apparatus includes a housing formed with a vertical channel along a back side of the housing and at least one groove across the housing. The housing includes a slot sized to receive a razor blade.

In another exemplary preferred embodiment, a blade disposal apparatus includes a housing with a slot sized to receive a razor blade and at least one external surface formed with visible indicia.

In another exemplary preferred embodiment, a blade disposal apparatus includes a housing with a front side and a back side, the housing being formed with a channel along the back side and at least one groove across the front side. The housing includes a slot sized to receive a razor blade and at least one external surface shaped into visible indicia.

The above described and many other features and attendant advantages of the present invention will become apparent as the invention becomes better understood by reference to the following detailed description when considered in conjunction with the accompanying drawings.

BRIEF DESCRIPTION OF THE DRAWINGS

Detailed description of preferred embodiments of the inventions will be made with reference to the accompanying drawings.

DETAILED DESCRIPTION OF THE PREFERRED EMBODIMENTS

The following is a detailed description of the best presently known mode of carrying out the invention. This description is not to be taken in a limiting sense, but is made merely for the purpose of illustrating the general principles of the invention.

Figure 1:
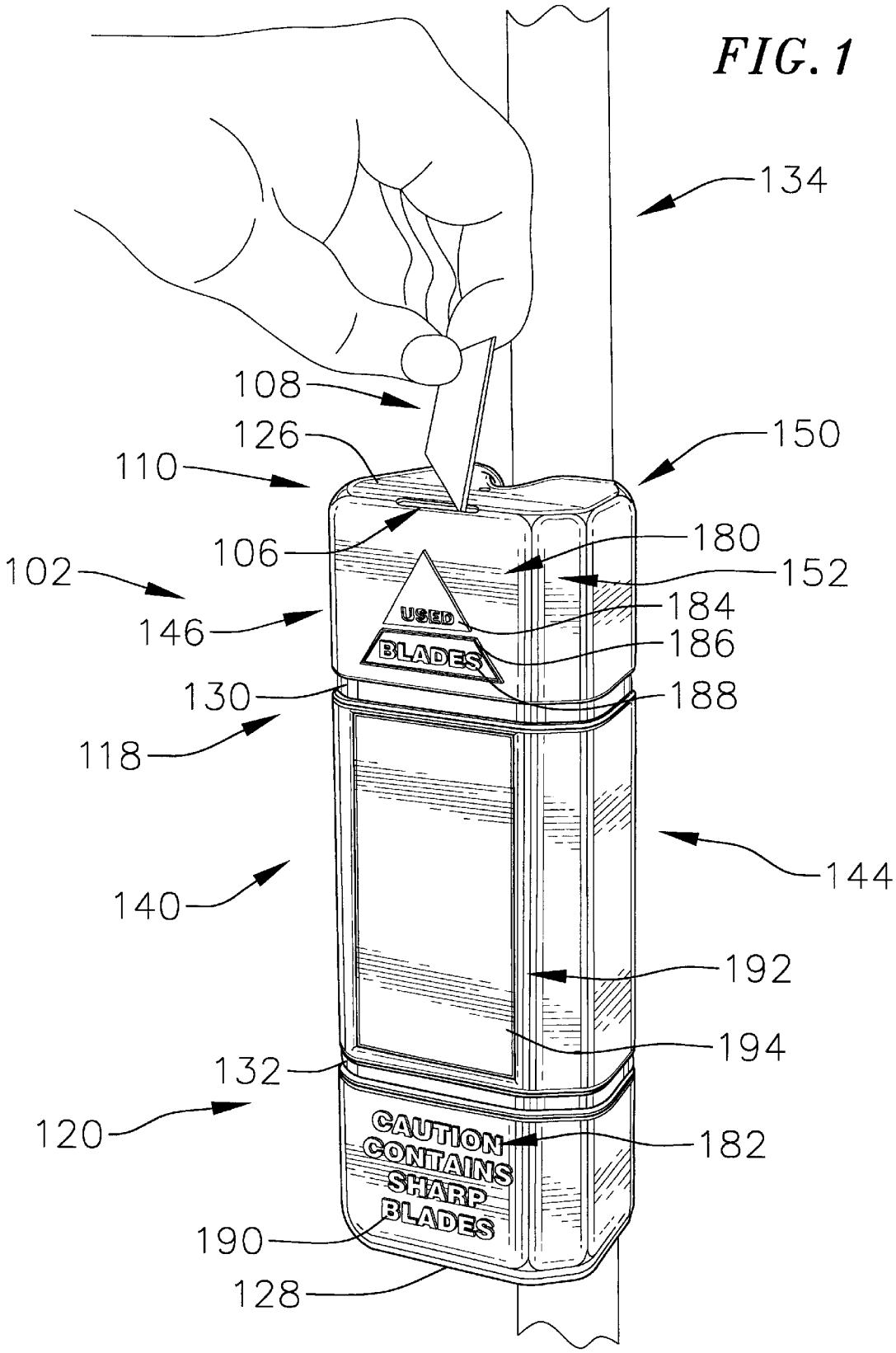
FIG. 1 is a front perspective view of an exemplary preferred blade disposal apparatus according to the present invention, showing the blade disposal apparatus secured to a vertical pole and a user inserting a blade into the blade disposal apparatus through a slot at a top portion of the blade disposal apparatus.
Figure 2:
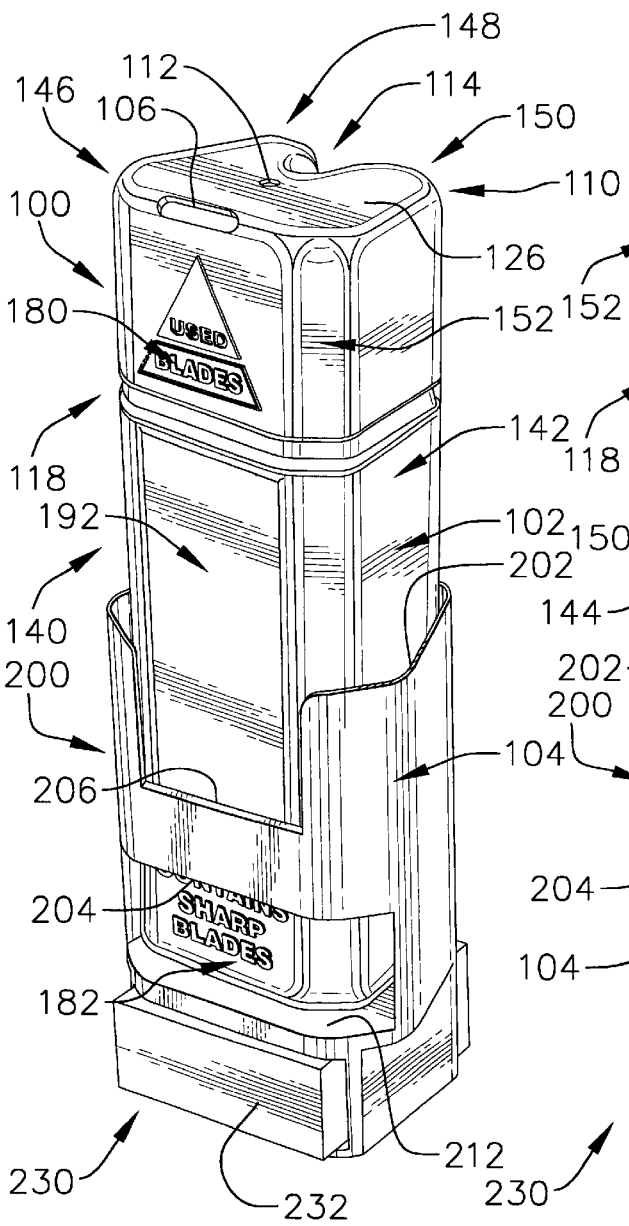
FIG. 2 is a front perspective view of an exemplary preferred blade disposal apparatus and holder unit according to the present invention.

Referring to FIGS. 1 and 2, an exemplary preferred blade disposal apparatus 100 according to the present invention includes a blade disposal unit 102 and a holder unit 104. The blade disposal unit or housing 102 includes a slot 106 cut-out area sized to receive a razor blade 108. The slot 106 is preferably positioned at a top portion 110 of the blade disposal unit 102 as shown. An exemplary preferred blade disposal unit 102 is sufficiently thick to be rigid, e.g., 0.05 inches nominal wall thickness, and formed from a thermoplastic resin, such as polypropylene, employing a conventional blow molding process resulting in a blow hole 112. Thus, the blade disposal unit 102 is a "closed" container except for the slot 106 and the blow hole 112 (which is preferably too small for a razor blade to pass through). If desired, the blow hole 112 can be sealed so that the blade disposal unit 102 is entirely closed except for the slot 106.

Referring to FIGS. 1 and 6–10, an exemplary preferred blade disposal unit 102 is formed with a vertical channel 114 along a back side 116 of the blade disposal unit 102 and at least one groove across the blade disposal unit 102. An exemplary preferred vertical channel 114 is formed as shown to accommodate poles with different diameters, as well as poles which are not cylindrical in shape.

Figure 3:
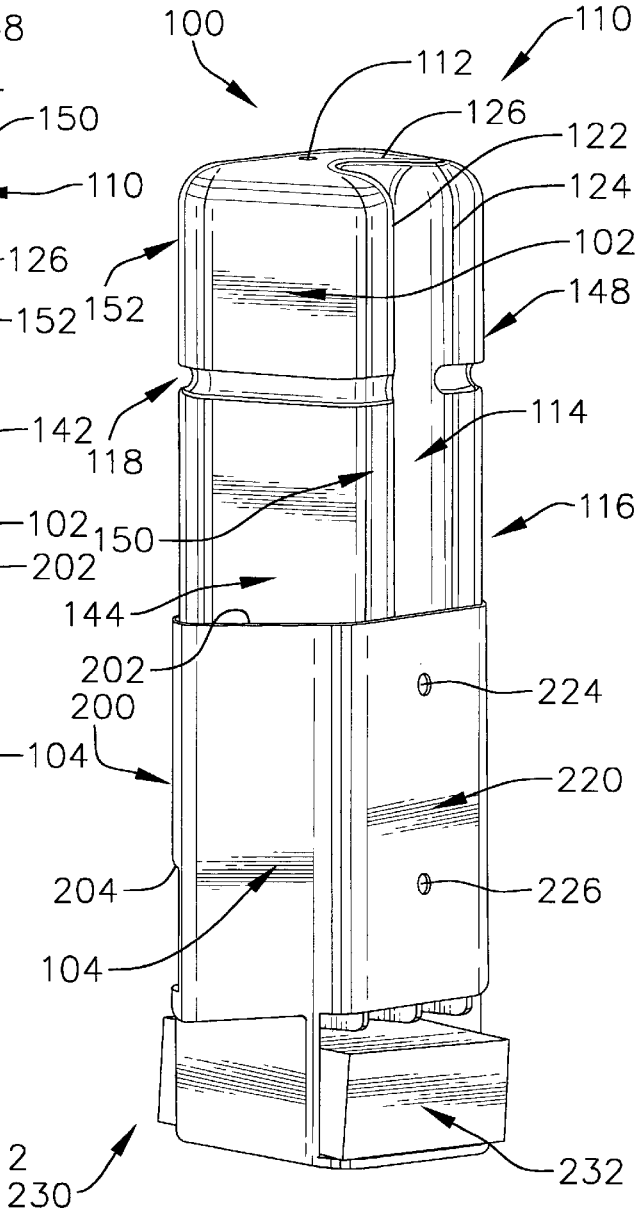
FIG. 3 is a back perspective view of the blade disposal apparatus and holder unit of FIG. 2.
Figure 4:
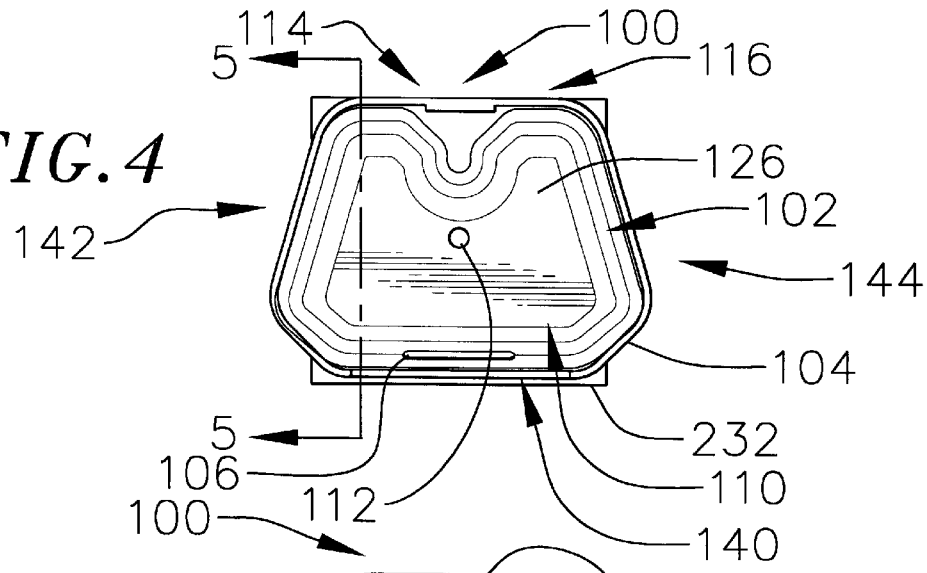
FIG. 4 is a top view of the blade disposal apparatus and holder unit of FIG. 2.
Figure 5:
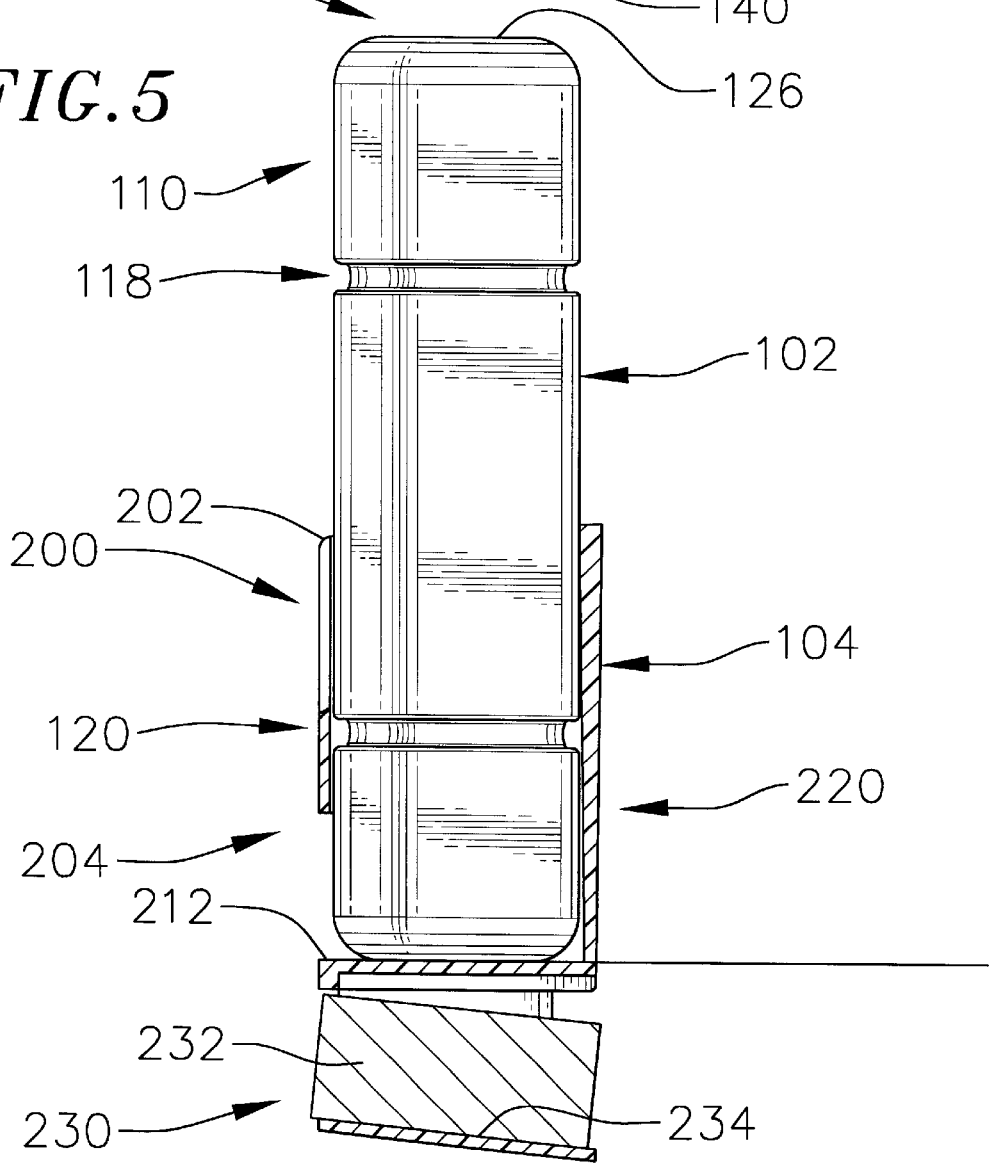
FIG. 5 is a cross-sectional view of the blade disposal apparatus and holder unit along line 5—5 of FIG. 4.
Figure 6:
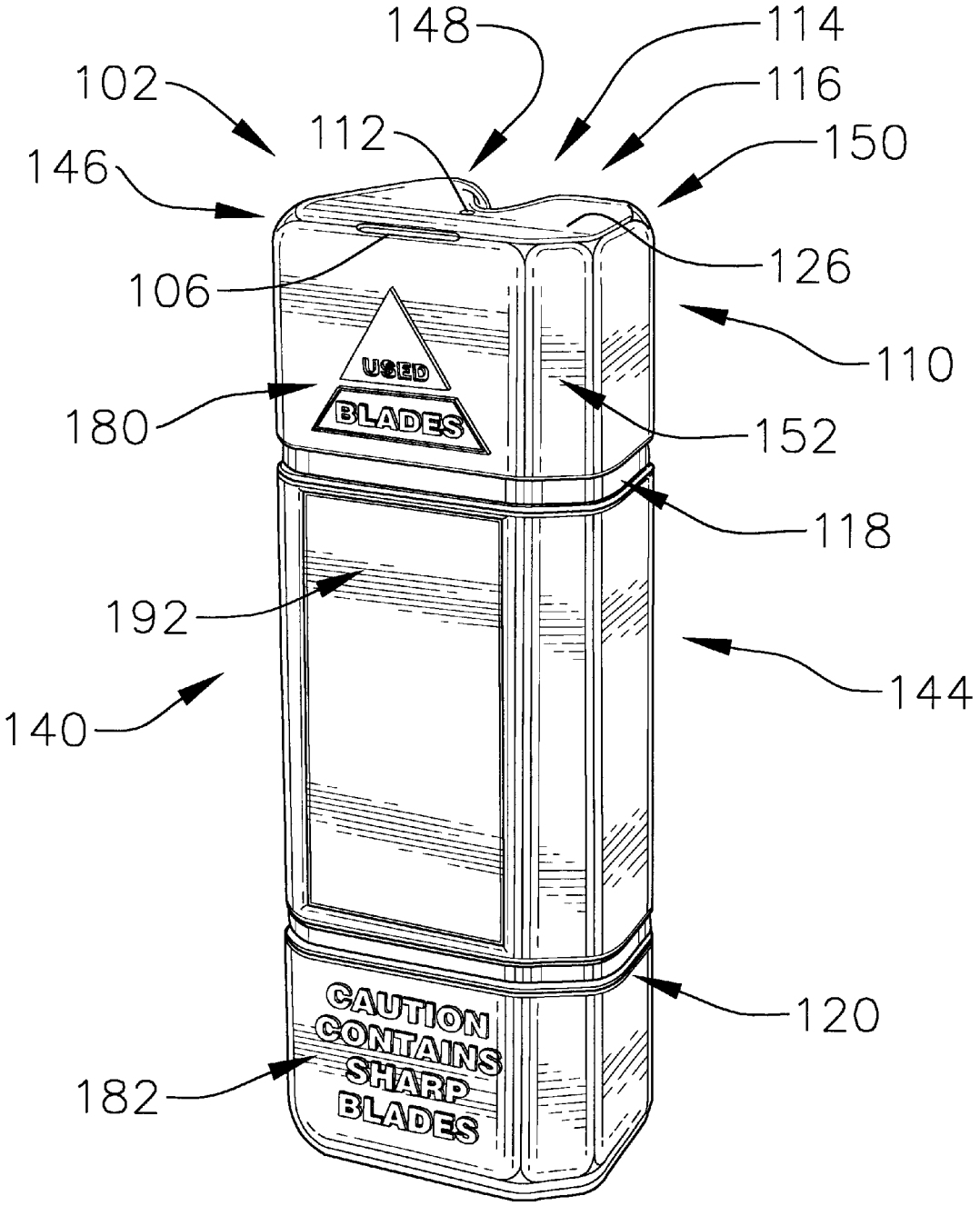
FIG. 6 is a front perspective view of the blade disposal apparatus of FIG. 1, showing only the blade disposal unit.
Figure 7:
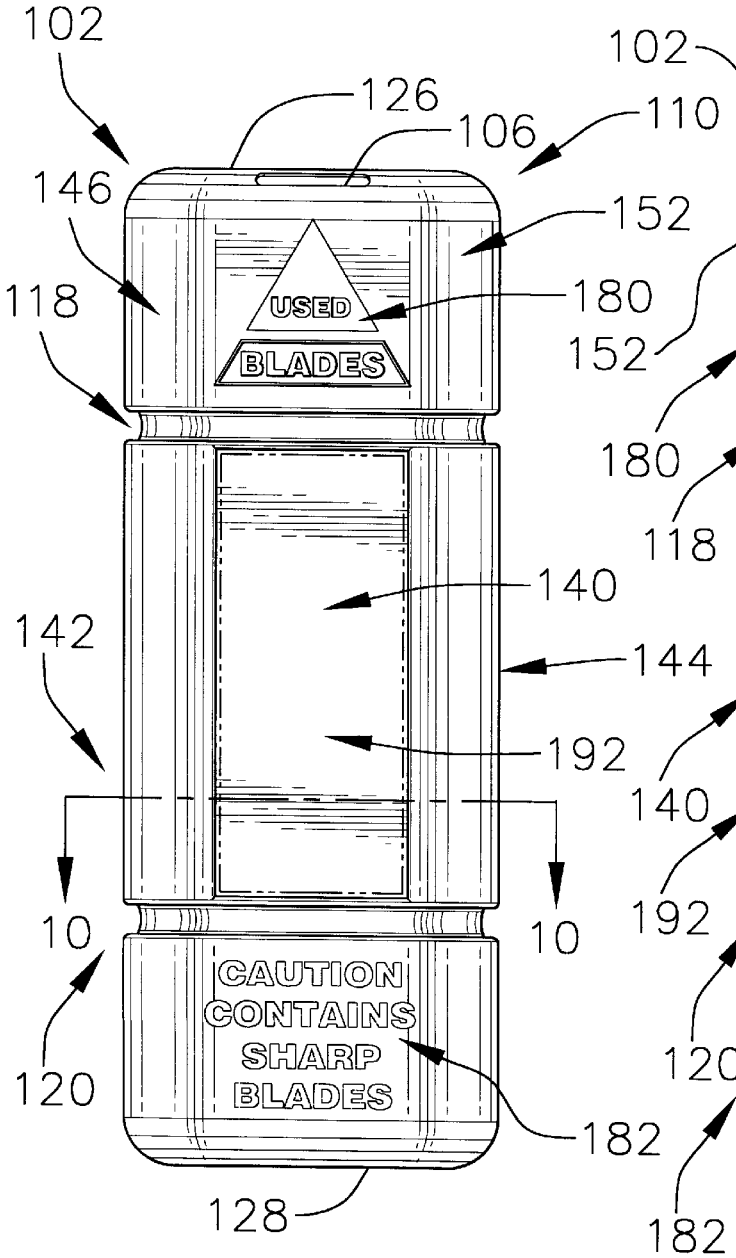
FIG. 7 is a front view of the blade disposal unit of FIG. 6.
Figure 8:
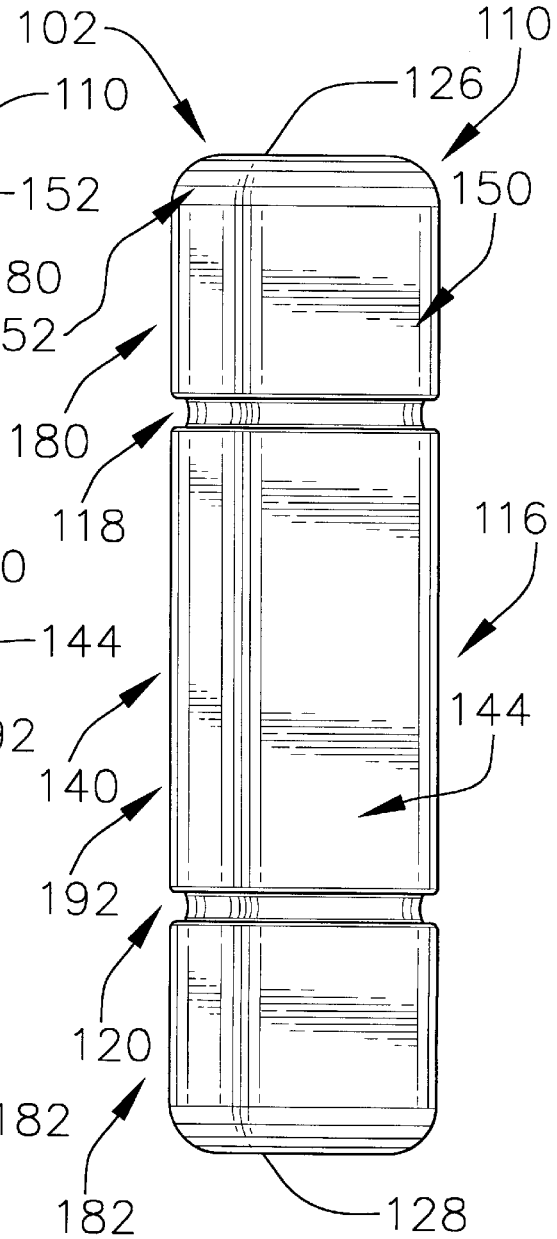
FIG. 8 is a side view of the blade disposal unit of FIG. 6.
Figure 9:
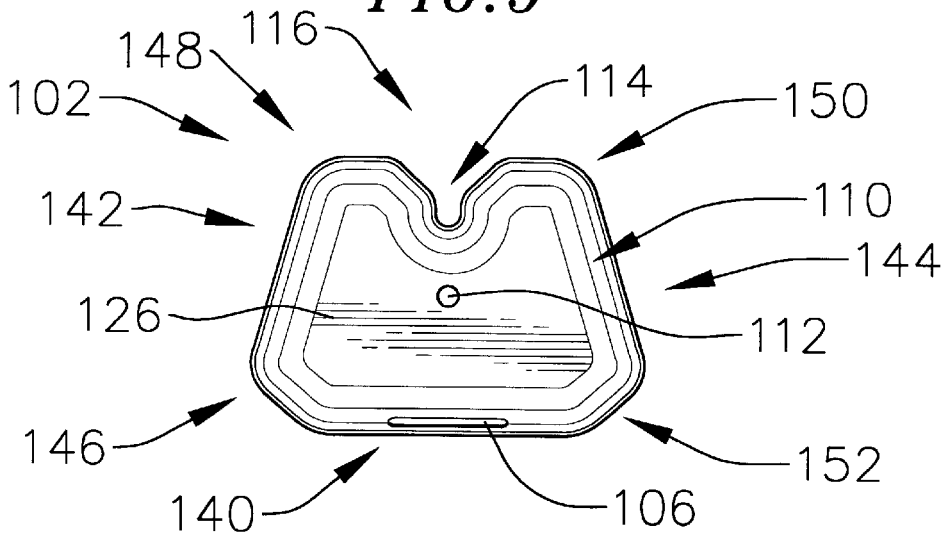
FIG. 9 is a top view of the blade disposal unit of FIG. 6.
Figure 10:
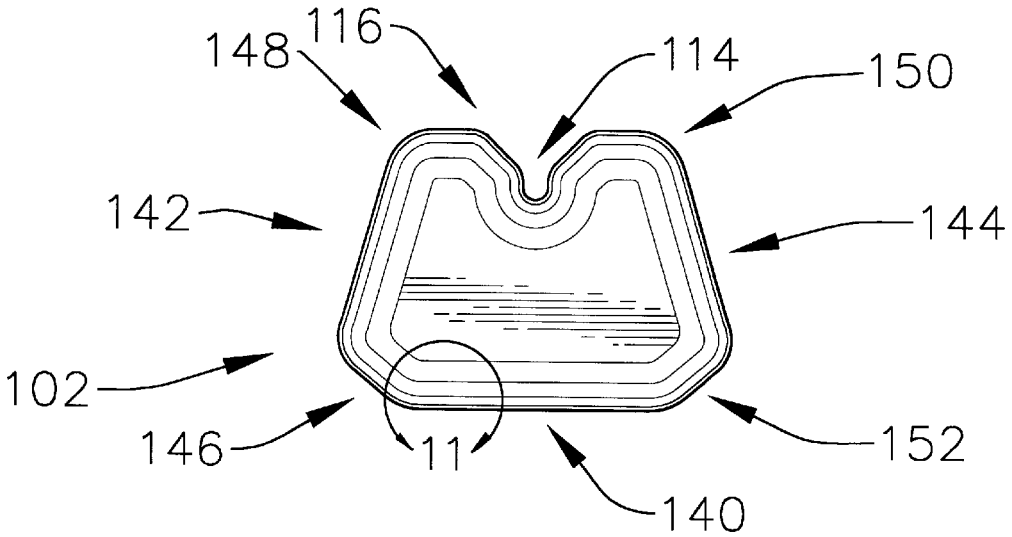
FIG. 10 is a cross-sectional view along line 10—10 of the blade disposal unit of FIG. 7.

Referring also to FIG. 3, the at least one groove preferably comprises grooves 118 and 120 which intersect the vertical channel 114. Exemplary preferred grooves 118 and 120 each extend continuously around the blade disposal unit 102 from a first side 122 of the vertical channel 114 to a second side 124 of the vertical channel 114 as shown. Preferably, the grooves 118 and 120 are positioned symmetrically along the length of the blade disposal unit 102. For example, the illustrated grooves 118 and 120 are equidistant from a top surface 126 of the blade disposal unit 102 and a bottom surface 128 of the blade disposal unit 102, respectively. Although the exemplary preferred grooves 118 and 120 are horizontal, i.e., perpendicular to the vertical channel 114, it should be understood that the present invention is not limited to such an arrangement. Furthermore, the at least one groove can also comprise a single groove or three or more grooves.

Referring to FIG. 1, an exemplary preferred blade disposal apparatus 100 also includes a plurality of ties for securing the blade disposal unit 102 to a pole 134 as shown. The plurality of ties comprise, for example, plastic ties 130 and 132 which are sized to fit within the grooves 118 and 120, respectively. Since the typical tie member is not as wide as the typical pole to which the blade disposal unit 102 is secured, the grooves 118 and 120 are preferably, but not necessarily, narrower in width than the vertical channel 114.

Referring to FIGS. 1–10, the exemplary preferred blade disposal unit 102 includes a front side 140, a left side 142, a right side 144 and curved corner portions 146, 148, 150 and 152 adjoined as shown. Preferably, the distance across the blade disposal unit 102, between the left side 142 and the right side 144, decreases moving from the front to the back of the blade disposal unit 102. In the exemplary preferred blade disposal unit 102, the top surface 126 and the bottom surface 128 are also joined to the back side 116, the front side 140, the left side 142 and the right side 144 by a plurality of curved corner portions as shown. Thus, the exemplary preferred blade disposal unit 102 is free of sharp edges or corners other than the slot 106 and the blow hole 112, if present.

In lieu of the plastic ties 130 and 132, the holder unit 104 is used when the blade disposal unit 102 is to be secured to an object, such as a wall or a board with a flat or substantially flat surface.

The ergonomic shape of the blade disposal unit 102 facilitates secure and comfortable gripping of the blade disposal unit 102, e.g., for putting the blade disposal unit 102 into or withdrawing it from the holder unit 104. More specifically, an inside edge of the thumb of a person's gripping hand is placed into the groove 118 on the front side 140 of the blade disposal unit 102. The tips of the other fingers of that same hand are placed into the vertical channel 114 with the palm of the hand facing either the left side 142 or the right side 144 of the blade disposal unit 102. So held, the shape of the blade disposal unit 102 and its groove 118 and vertical channel 114 allow the blade disposal unit 102 to be securely gripped even if the blade disposal unit 102 is slippery or wet.

Referring to FIGS. 1 and 6–11, the exemplary preferred blade disposal unit 102 includes at least one external surface formed with visible indicia. The at least one external surface comprises, for example, a first surface 180 and a second surface 182 which are both positioned on the front side 140 of the blade disposal unit 102. The first surface 180 is preferably positioned adjacent the slot 106. The second surface 182 is preferably positioned between the groove 120 and the bottom surface 128.

Generally, the visible indicia include text and/or symbols pertaining to the blade disposal apparatus 100 or its contents. Exemplary preferred visible indicia are formed in the blade disposal unit 102 or secured to it in a manner which prevents the visible indicia from being readily removed, obliterated or tampered with. Exemplary preferred visible indicia comprise raised and/or sunken portions of the surfaces 180 and 182. For example, and referring to FIG. 1, an exemplary preferred first surface 180 is formed with raised portions 184, 186 and 188. An exemplary preferred raised portion 184 is triangle-shaped with a top corner of the triangle pointing toward the slot 106. Within the raised portion 184, a sunken portion formed as the word "USED" as centrally positioned as shown. An exemplary preferred raised portion 186 forms a trapezoid-shaped border which extends the triangle base of the raised portion 184. An exemplary preferred raised portion 188 forms the word "BLADES" and is positioned inside the raised portion 186 as shown. Thus, the visible indicia (the raised portions 184, 186 and 188) formed on the first surface 180 provide instructions for using the blade disposal apparatus 100.

An exemplary preferred second surface 182 includes a raised portion 190 which forms, for example, the words "CAUTION CONTAINS SHARP BLADES". Thus, the visible indicia (the raised portion 190) formed on the second surface 182 provide safety information pertaining to the blade disposal apparatus 100. It should be understood that the visible indicia formed on the surfaces 180 and 182 are not limited to the specific instructions and safety information described above. Furthermore, the surfaces 180 and 182 can be positioned differently on the front side 140 or on a portion of the blade disposal unit 102 other than the front side 140.

Figure 11:
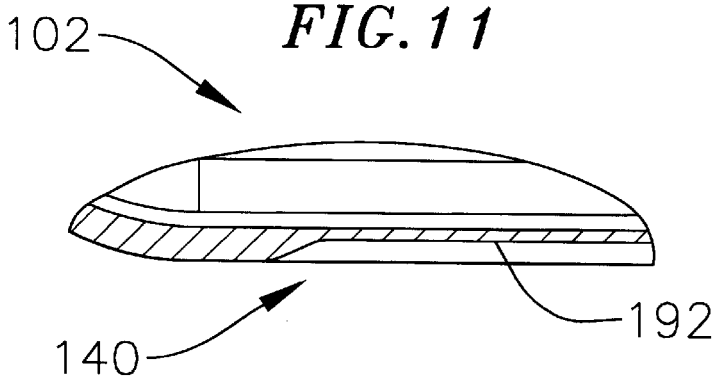
FIG. 11 is an enlarged view of the blade disposal unit within the arc 11—11 of FIG. 10.
Figure 13:
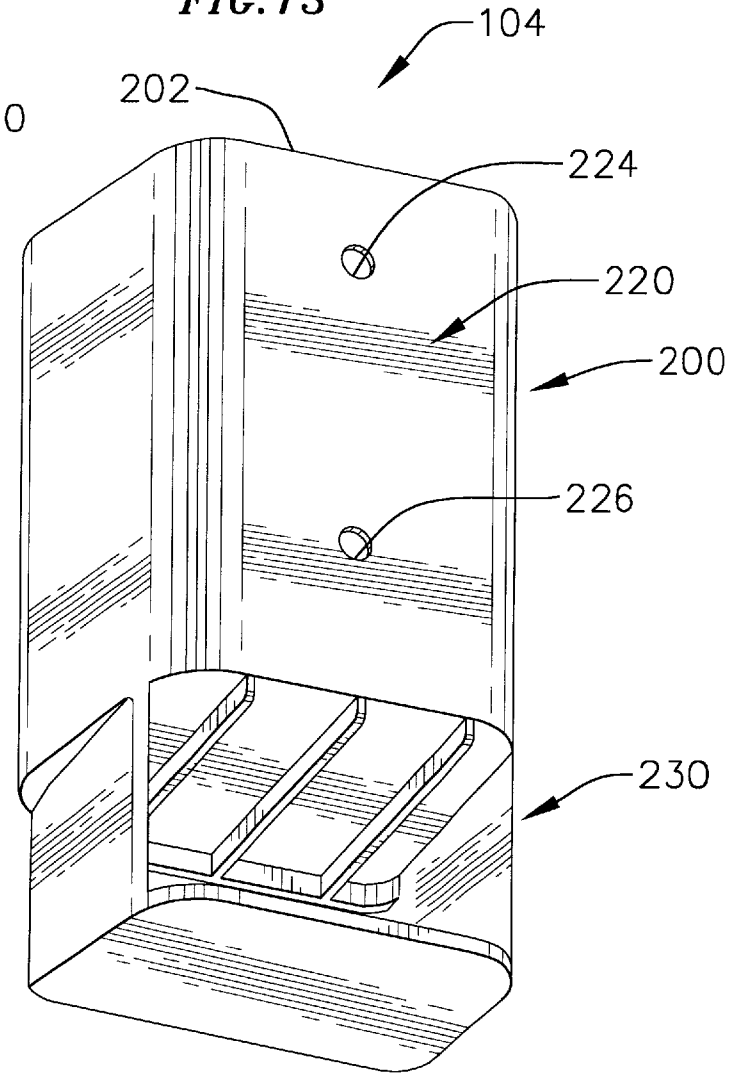
FIG. 13 is a rear perspective view of the holder unit of FIG. 12.
Figure 12:
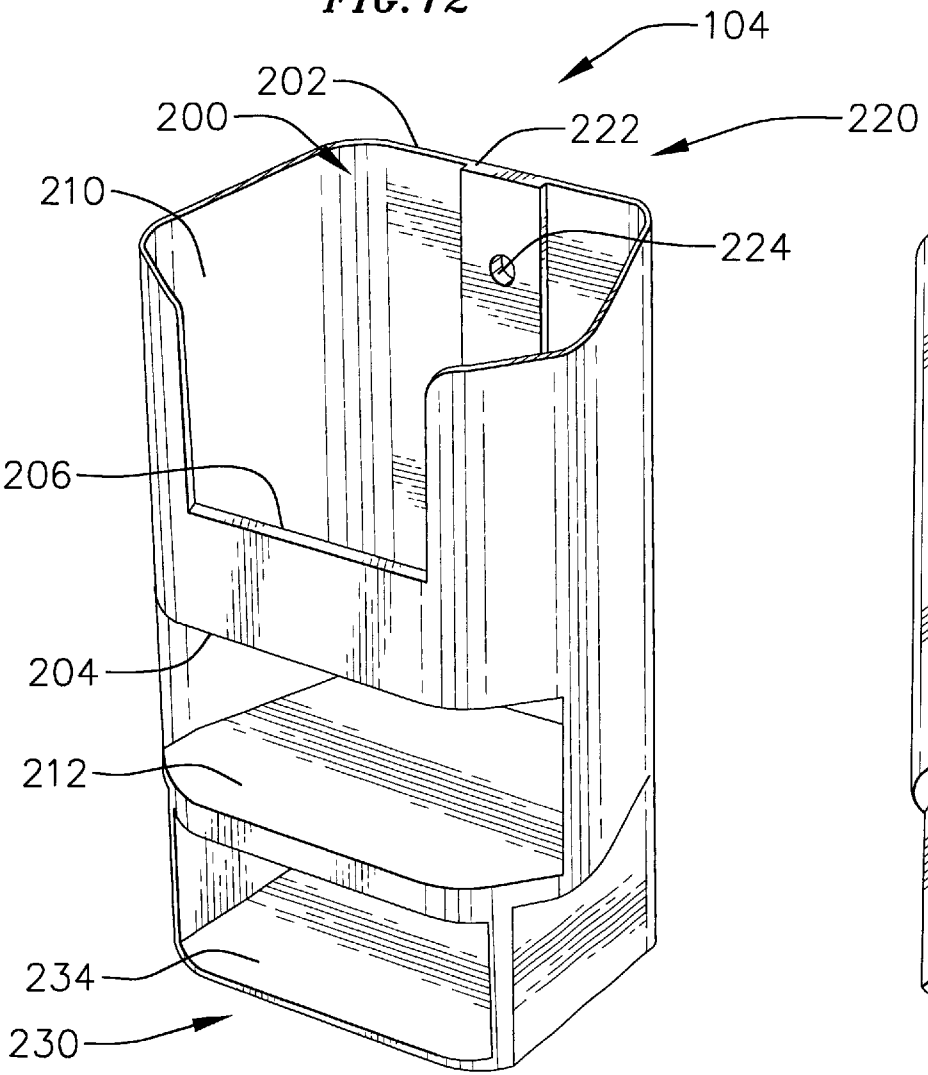
FIG. 12 is a front perspective view of the exemplary preferred holder unit shown in FIGS. 2–5.
Figures 14, 15:
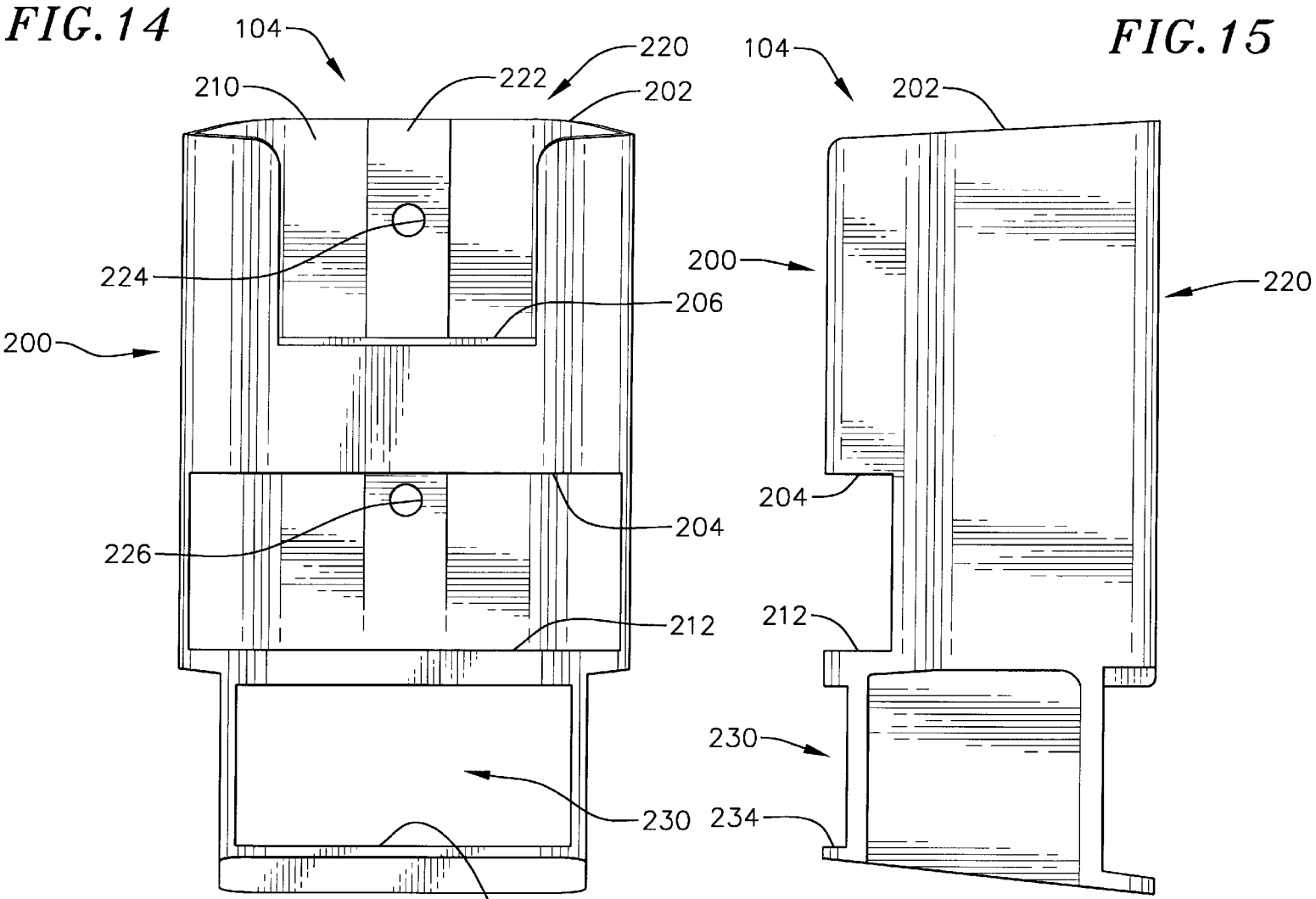
FIG. 14 is a front view of the holder unit of FIG. 12.
FIG. 15 is a side view of the holder unit of FIG. 12.
Figure 16:
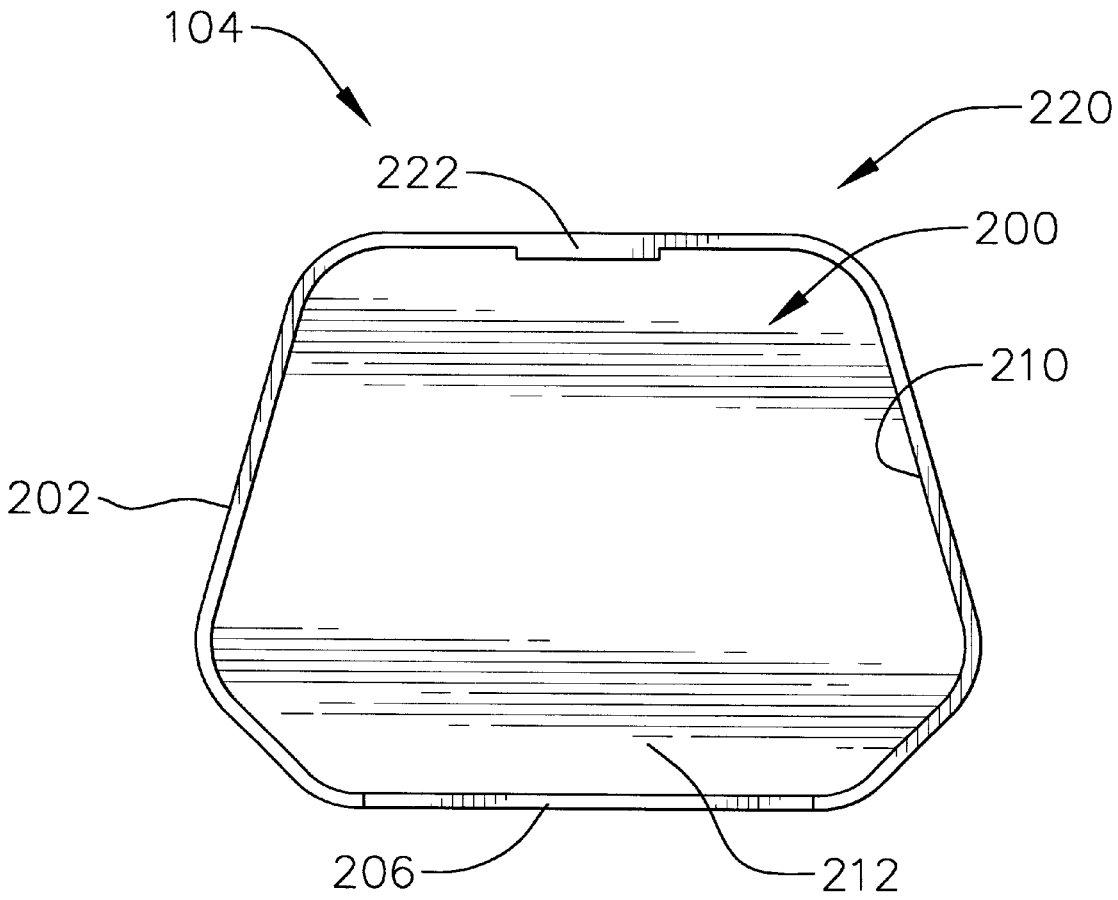
FIG. 16 is a top view of the holder unit of FIG. 12.

In a preferred embodiment, the blade disposal unit 102 also includes a label surface 192 suitable for supporting a label 194 which is adhered to the label surface 192 in a conventional fashion. The label surface 192 is preferably positioned on the front side 140 of the blade disposal unit 102 between the grooves 118 and 120. Referring to FIG. 11, an exemplary preferred label surface 192 is slightly recessed for receiving the label 194. An exemplary preferred label 194 includes additional instructions and safety information or other visible indicia such as business logos, advertisements, etc.

Referring to FIGS. 2–5 and 12–16, an exemplary preferred holder unit 104 includes a main compartment 200 sized to receive the blade disposal unit 102. In a preferred embodiment, the holder unit 104 is a single piece formed from a thermoplastic resin, such as polypropylene, and has a nominal wall thickness of 0.125 inches. However, it should be understood that the present invention also encompasses a holder unit 104 which is assembled from more than one piece, formed from different materials and/or dimensioned differently.

The exemplary preferred holder unit 104 is formed such that the visible indicia are exposed when the blade disposal unit 102 is inserted into the holder unit 104. More specifically, the exemplary preferred holder unit 104 includes a top edge 202 which is positioned below the first surface 180 and an opening 204 through which the second surface 182 is visible when the blade disposal unit 102 is inserted into the holder unit 104. Preferably, the top edge 202 of the holder unit 104 includes a recessed portion 206 formed such that the label surface 192 is also visible when the blade disposal unit 102 is inserted into the holder unit 104.

An exemplary preferred main compartment 200 includes an inner wall 210 and a bottom wall 212. As illustrated, the exemplary preferred inner wall 210 is formed to complement the shape of the blade disposal unit 102 and, more specifically, the shape of the back side 116, the front side 140, the left side 142, the right side 144 and the curved corner portions 146, 148, 150 and 152. When the blade disposal unit 102 is inserted into the holder unit 104, the bottom wall 212 contacts the bottom surface 128 of the blade disposal unit 102.

An exemplary preferred holder unit 104 includes a rear portion 220 with a reinforced inner wall portion 222. An exemplary preferred rear portion 220 is flat or substantially flat for mounting the holder unit 104 to an object such as a wall or board in or near the work area. To this end, the exemplary preferred holder unit 104 includes a mounting mechanism such as apertures 224 and 226 which are positioned as shown along the reinforced inner wall portion 222. Conventional flat head screws or the like are placed through the apertures 224 and 226 and screwed into the object to which the holder unit 104 is to be secured. Securing mechanisms other than the apertures 224 and 226 can also be employed.

The exemplary preferred holder unit 104 also includes a blade compartment 230 sized to receive a box 232 of new razor blades. An exemplary preferred blade compartment 230 includes a tilted bottom surface 234 which supports the box 232 of razor blades. More specifically, the surface 234 is tilted relative to the rear portion 220 such that the box 232 tends to slide toward the rear portion 220 when the holder unit 104 is in an upright position. The tilted bottom surface 234 lessens the changes that the box 232 of blades will fall out of the blade compartment 230.

Figure 17:
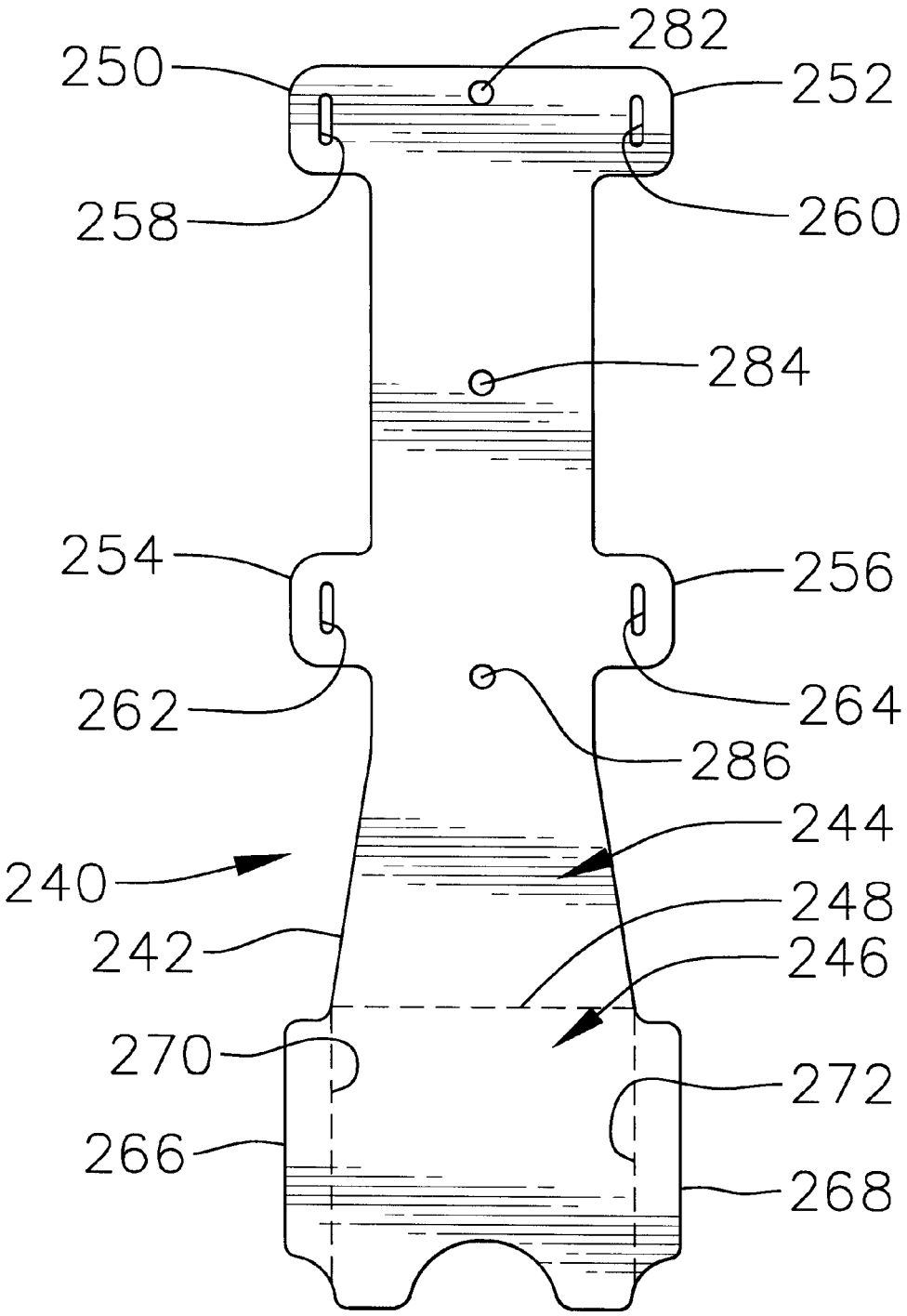
FIG. 17 is a front view of a flat blank layout for an alternative exemplary preferred holder unit.

Referring to FIGS. 17–20, an alternative exemplary preferred holder unit 240 is shown. In a preferred embodiment, the holder unit 240 is formed from a flat blank layout 242 as shown in FIG. 17. An exemplary preferred blank 242 comprises a 0.060 inch thick piece of aluminum formed with a back portion 244 and a bottom portion 246 (shown separated by a dashed line 248). The illustrated back portion 244 includes four arm portions 250, 252, 254 and 256 with apertures 258, 260, 262 and 264, respectively. The illustrated bottom portion 246 includes edge portions 266 and 268. Dashed lines 270 and 272 separate the bottom portion 260 from the edge portions 266 and 268, respectively.

Figure 18:
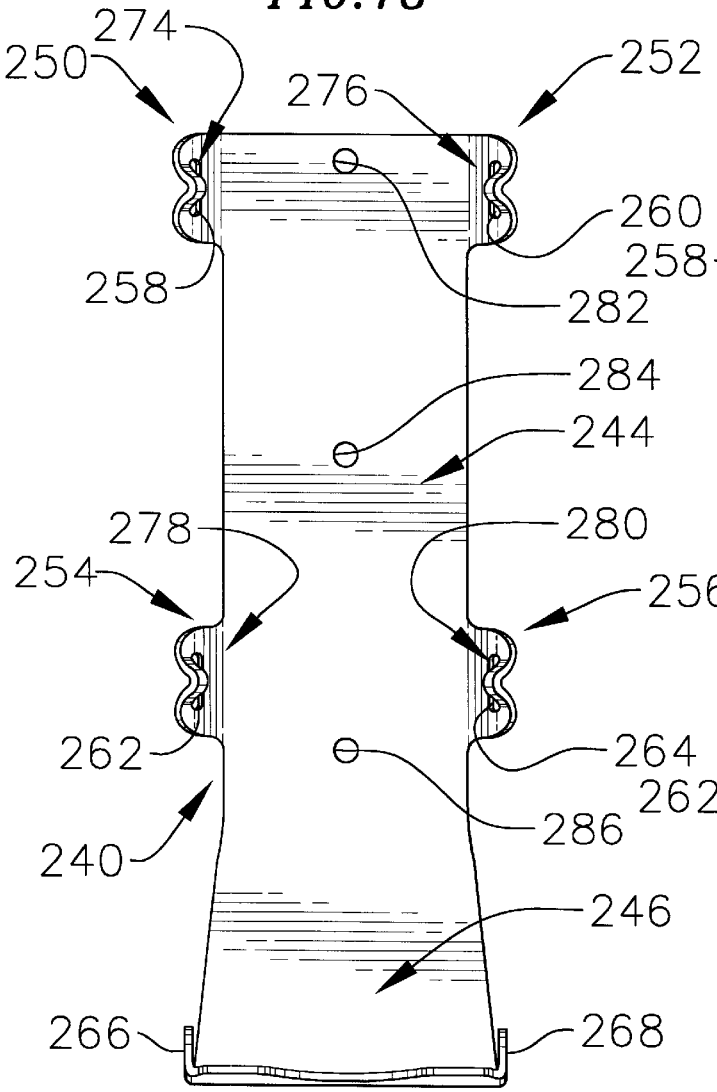
FIG. 18 is a front view of the alternative exemplary preferred holder unit of FIG. 17.
Figure 19:
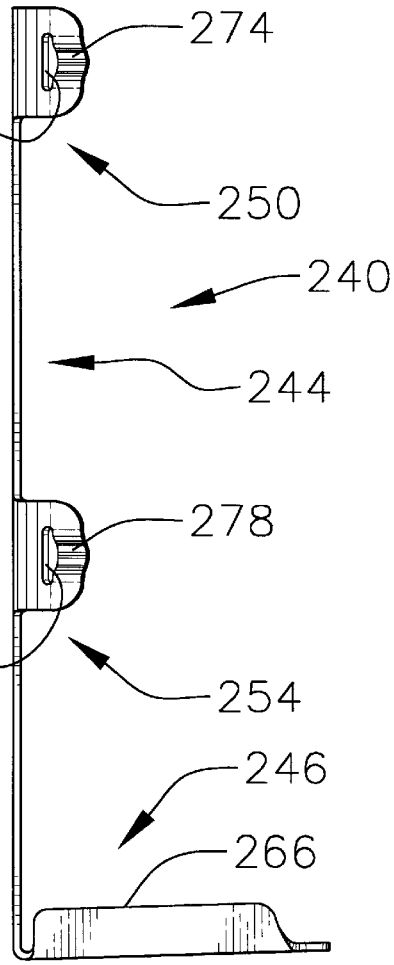
FIG. 19 is a side view of the alternative exemplary preferred holder unit of FIG. 17.
Figure 20:
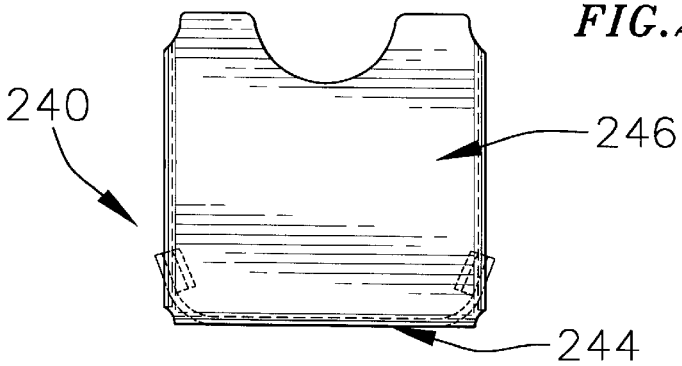
FIG. 20 is a bottom view of the alternative exemplary preferred holder unit of FIG. 17.

The holder unit 240 shown in FIGS. 18–20 is formed by folding the blank 244 along the dashed lines 248, 270 and 272 as shown. In the illustrated preferred embodiment, the edge portions 266 and 268 are folded to form right angles with the bottom portion 246 which, in turn, is folded to form an angle slightly smaller than 90° with the back portion 244. Additionally, the arm portions 244, 246, 248 and 250 are bent such that the back portion 244 complements the shape of the blade disposal unit 102 and, more specifically, the shape of the back side 116, the left side 142, the right side 144 and the curved corner portions 148 and 150. The arm portions 244, 246, 248 and 250 are bent between their outer edges and apertures 258, 260, 262 and 264 to form curved portions 274, 276, 278 and 280, respectively. The curved portions 274, 276, 278 and 280 are formed such that their inner sides fit within the grooves 118 and 120 and their outer sides provide grooves suitable for receiving tie members or the like therein to secure the blade disposal unit 102 against the back portion 244. The bottom portion 246 is sized and shaped to support a box of new razor blades below the blade disposal unit 102 when the blade disposal unit 102 is secured to the back portion 244. As discussed above, the bottom portion 246 is preferably bent or otherwise formed relative to the back portion 244 such that the box of blades will tend to slide toward the back portion 244 when the holder unit 240 is in an upright position.

The illustrated exemplary holder unit 240 also includes a mounting mechanism such as apertures 282, 284 and 286 which are positioned as shown along the back portion 244. It should be understood that the holder unit 240 can be formed from other materials and is not necessarily made from a single piece or in the manner described above.

Figure 21:
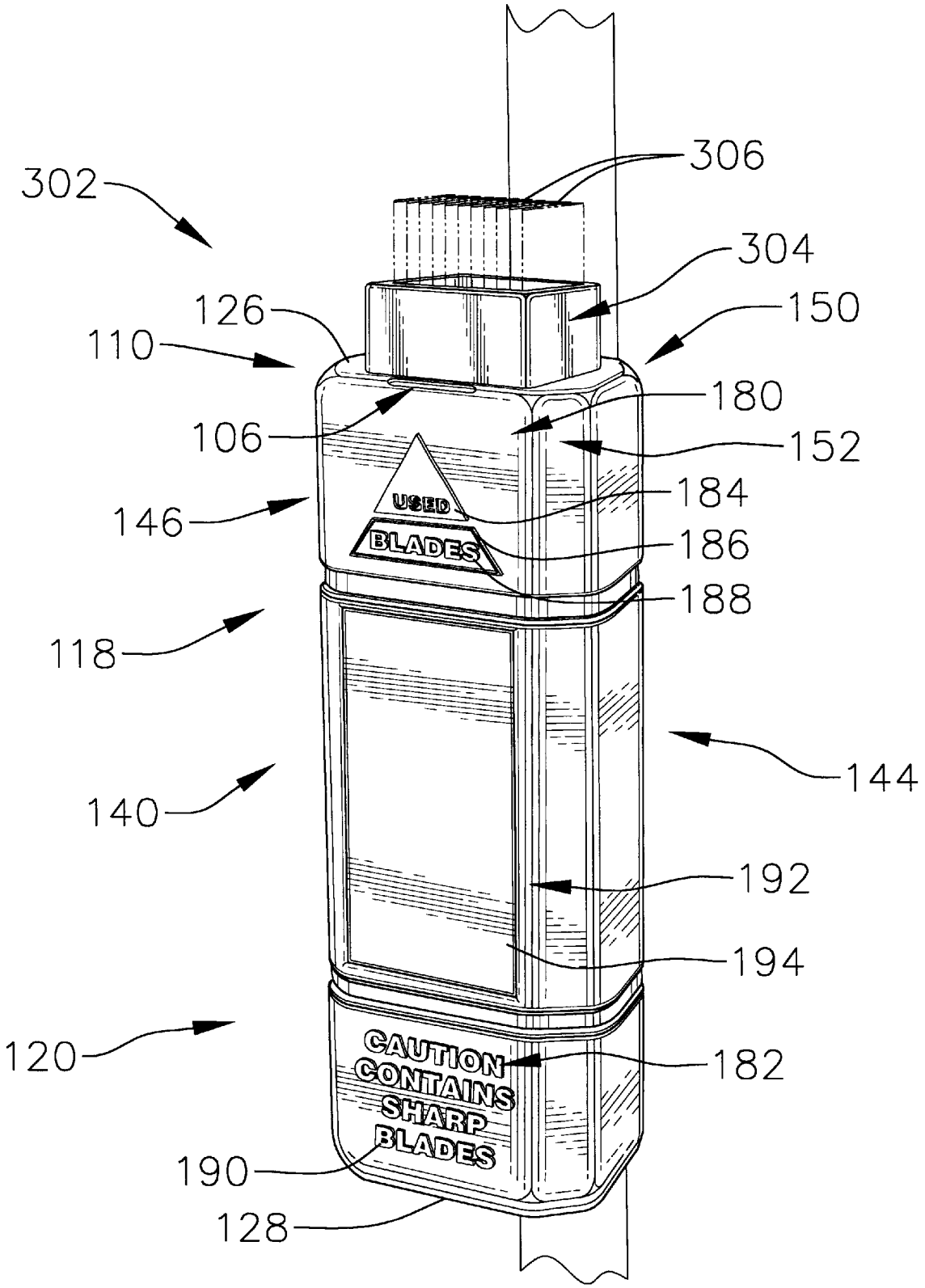
FIG. 21 is a front perspective view of an alternative exemplary preferred blade disposal unit according to the present invention.

Referring to FIG. 21, an alternative exemplary preferred blade disposal unit 302 includes a blade holder unit 304 formed as shown on the top surface 126. The blade holder 304 is sized and shaped as shown to hold packs of blades 306 therein. In a preferred embodiment, the blade holder 304 is integrally formed with or molded to the blade disposal unit 302 and formed from like materials. To the extent that their like elements are denoted by like numerals, the blade disposal unit 302 and the previously described blade disposal unit 102 are the same.

Although the present invention has been described in terms of the preferred embodiment above, numerous modifications and/or additions to the above-described preferred embodiment would be readily apparent to one skilled in the art. It is intended that the scope of the present invention extend to all such modifications and/or additions.

I claim:

1. A blade disposal apparatus, comprising:

a housing formed with a vertical channel along a back side of the housing and at least one groove across the housing, the housing including a slot sized to receive a razor blade, the vertical channel having a channel width, and the at least one groove having a groove width which is smaller than the channel width.

2. A blade disposal apparatus, comprising:

a housing formed with a vertical channel along a back side of the housing and at least one groove across the housing, the housing including a slot sized to receive a razor blade, the at least one groove comprising two grooves which are positioned symmetrically along a length of the housing.

3. A blade disposal apparatus, comprising:

a housing formed with a vertical channel along a back side of the housing and at least one groove across the housing, the housing including a top surface, a bottom surface, and a slot sized to receive a razor blade, the at least one groove comprising a first groove and a second groove which are substantially equidistant from the top surface and the bottom surface, respectively.

4. A blade disposal apparatus, comprising:

a housing formed with a vertical channel along a back side of the housing and at least one groove across the housing, the housing including a slot sized to receive a razor blade; and a holder unit including a main compartment sized to receive the housing, a blade compartment sized to receive a box a razor blades, and a rear portion, the blade compartment including a surface upon which the box of razor blades is positioned, the surface being tilted relative to the rear portion such that the box of razor blades tends to slide toward the rear portion when the holder unit is in an upright position.

5. A blade disposal apparatus, comprising:

a housing including a slot sized to receive a razor blade and at least one external surface formed with visible indicia; and a holder unit including a main compartment sized to receive the housing, a blade compartment sized to receive a box a razor blades, and a rear portion, the blade compartment including a surface upon which the box of razor blades is positioned, the surface being tilted relative to the rear portion such that the box of razor blades tends to slide toward the rear portion when the holder unit is in an upright position.

6. A blade disposal apparatus, comprising:

a housing including a front side and a back side, the housing being formed with a channel along the back side and at least one groove across the front side, the housing including a slot sized to receive a razor blade and at least one external surface shaped into visible indicia.

7. A blade disposal apparatus as claimed in claim 6, further comprising:

a blade holder secured to the housing and sized to receive a pack of blades therein.

* * * * *